US008215382B2

(12) United States Patent
Schoonover

(10) Patent No.: US 8,215,382 B2
(45) Date of Patent: Jul. 10, 2012

(54) MOTION TRANSFER FROM A SEALED HOUSING

(75) Inventor: Larry G. Schoonover, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 407 days.

(21) Appl. No.: 12/498,145

(22) Filed: Jul. 6, 2009

(65) Prior Publication Data

US 2011/0000662 A1 Jan. 6, 2011

(51) Int. Cl.
*E21B 34/16* (2006.01)
*E21B 23/00* (2006.01)

(52) U.S. Cl. ..... 166/66; 166/373; 166/66.4; 166/66.6

(58) Field of Classification Search ..... 166/373, 166/66, 66.4, 66.6
See application file for complete search history.

(56) References Cited

U.S. PATENT DOCUMENTS

| | | | |
|---|---|---|---|
| 3,208,541 | A | 9/1965 | Lawrence |
| 3,392,795 | A | 7/1968 | Greer |
| 3,570,612 | A | 3/1971 | Slator |
| 3,606,297 | A | 9/1971 | Webb |
| 3,949,821 | A | 4/1976 | Raugust |
| 4,111,271 | A | 9/1978 | Perkins |
| 4,161,224 | A | 7/1979 | Hostrup |
| 4,361,195 | A | 11/1982 | Evans |
| 4,593,771 | A | 6/1986 | Comeau |
| 4,658,917 | A | 4/1987 | Ring |
| 4,865,125 | A | 9/1989 | De Cuir |
| 5,007,479 | A | 4/1991 | Pleasants et al. |
| 5,033,557 | A | 7/1991 | Askew |
| 5,058,673 | A | 10/1991 | Muller et al. |
| 5,070,940 | A | 12/1991 | Conner et al. |
| 5,287,921 | A | 2/1994 | Blount et al. |
| 5,358,035 | A | 10/1994 | Grudzinski |
| 5,369,675 | A | 11/1994 | Diaz et al. |
| 5,931,242 | A | 8/1999 | Oettli |
| 6,364,023 | B1 | 4/2002 | Hiron et al. |
| 7,025,130 | B2 | 4/2006 | Bailey et al. |
| 7,185,699 | B2 | 3/2007 | Zazovsky et al. |
| 7,451,809 | B2 | 11/2008 | Noske et al. |
| 2008/0128137 | A1 | 6/2008 | Anderson et al. |

FOREIGN PATENT DOCUMENTS

| | | |
|---|---|---|
| EP | 1473435 A1 | 11/2004 |
| UA | 19496 | 12/2006 |
| WO | 03/033859 A1 | 4/2003 |

*Primary Examiner* — Giovanna Wright
(74) *Attorney, Agent, or Firm* — Steve Rosenblatt

(57) ABSTRACT

A source of motion for actuation of a downhole tool is in a sealed housing to protect it from well fluids. The sealed housing is filled with an incompressible fluid and thermal effects can be compensated preferably with a compensation bellows in communication with the fluid. The source of motion is preferable electrically powered and the longitudinal motion that results presses against a bellows within the sealed housing. This master bellows is in sealed contact with a slave bellows through a rigid housing that is seal welded to the housing wall. Movement of the master bellows in the housing results in an equal movement of the slave bellows outside the housing. Feedback loops or calibration for thermal effects are also contemplated.

17 Claims, 1 Drawing Sheet

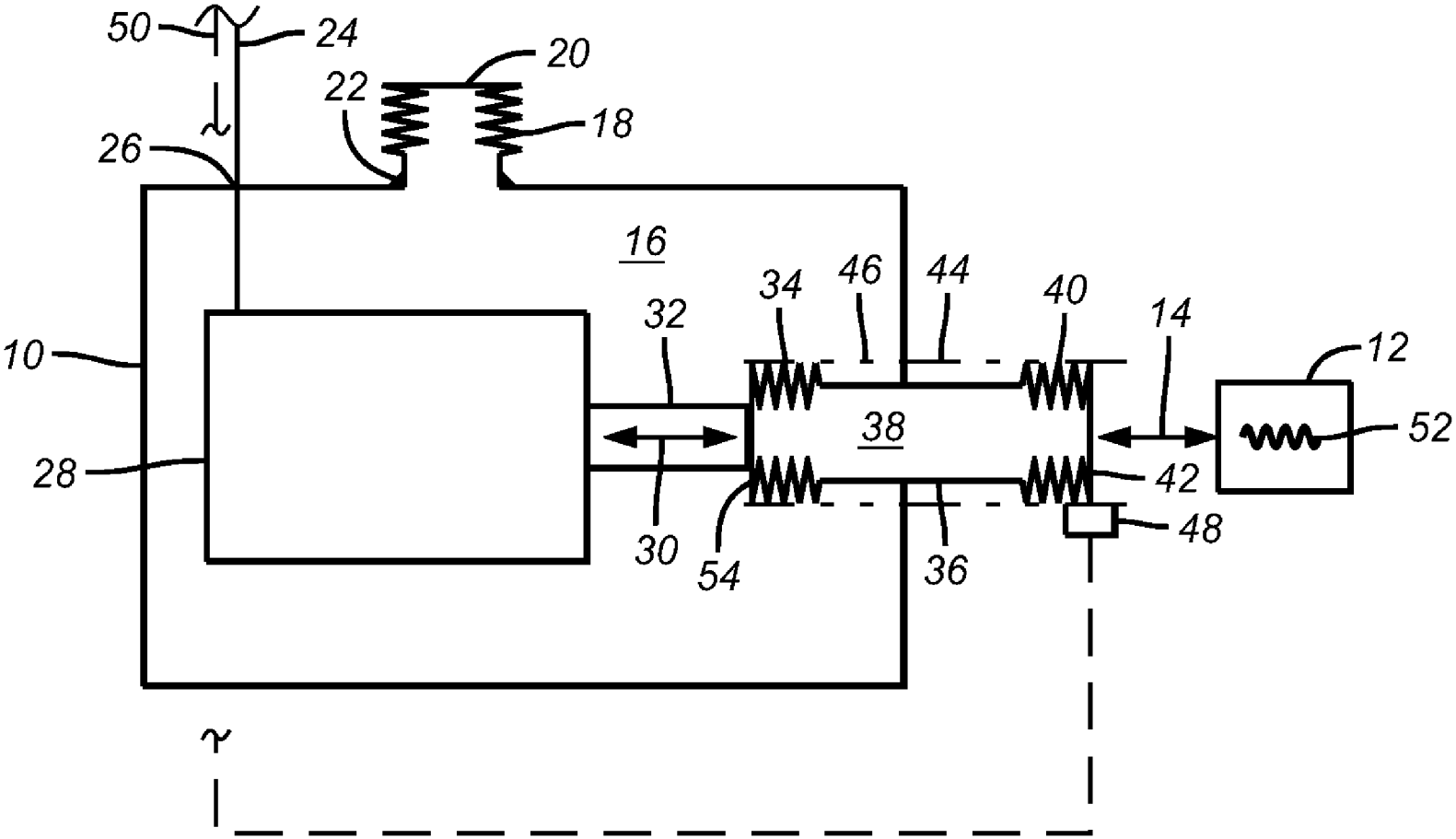
12
52
14
42
48
40
44
36
38
46
34
54
32
30
16
18
20
22
24
50
26
10
28

MOTION TRANSFER FROM A SEALED HOUSING

FIELD OF THE INVENTION

The field of this invention is devices that require isolation from subterranean fluids for long term reliability which are capable of actuating another device exposed to well fluids for performing a downhole operation.

BACKGROUND OF THE INVENTION

The service life of some wells can be decades long. Many such wells have downhole devices that are remotely actuated. In some applications the actuator assemblies must be located downhole. Some downhole devices require fairly precise movements for proper control of the downhole operation. For example, valves have a variable orifice feature that regulates the amount of the flow that is delivered per unit time.

Over long periods of use, actuator systems that use resilient seals can experience seal failure that allows the downhole fluids to reach the precision components of the actuator and an ultimate failure of the actuator. This requires an expensive overhaul that causes lost production or at least delayed production and the associated expense of the workover to get the broken actuation equipment removed from the wellbore so it can be either repaired or replaced.

A better way that is offered by the present invention is to encase the actuation equipment in a manner to seal it from well fluids to ensure its long term trouble free operation. The operation of the actuation equipment within the sealed enclosure is transferred through a sealed transfer device through the wall of the sealed enclosure to the device or tool on the outside whose movement is needed to control the downhole function. In a preferred embodiment the actuator moves a bellows in the isolated enclosure that triggers a response in a slave bellows that is operably connected to the downhole tool being controlled. In between the master and slave bellows there is a body that is sealed to an opening in the fluid enclosure preferably by welding. In a preferred application the ultimate controlled element moved by this system is one or more variable orifice valves. Position sensors can be optionally used as one form of feedback for calibration of the device. The master/slave bellows can be optionally guided in their movements and the thermal effects within the sealed enclosure can be compensated by a discrete relief device, such as another bellows.

Bellows have been used to transfer actuator movement to a remote location all within a nuclear reactor as shown in U.S. Pat. No. 5,369,675. Other patents and applications in the general field of transfer of force through hydraulic systems are: U.S. Pat. Nos. 3,208,541; 3,392,795; 3,570,612; 3,606,297; 3,949,821; 4,111,271; 4,161,224; 4,361,195; 4,593,771; 4,658,917; 4,865,125; 5,007,479; 5,033,557; 5,058,673; 5,070,940; 5,287,921; 5,931,242; 7,025,130 and 7,185,699. The following other patents are also relevant: UA 19496; EP 1473435 and WO 03033859.

Those skilled in the art will appreciate that there are a variety of downhole applications that the present invention can be used and a better understanding of the extent of the invention can be better appreciated from a review of the description of the preferred embodiment and the associated FIGURE while recognizing that the full scope of the invention is determined by the appended claims.

SUMMARY OF THE INVENTION

A source of motion for actuation of a downhole tool is in a sealed housing to protect it from well fluids. The sealed housing is filled with an incompressible fluid and thermal effects can be compensated preferably with a compensation bellows in communication with the fluid. The source of motion is preferable electrically powered and the longitudinal motion that results presses against a bellows within the sealed housing. This master bellows is in sealed contact with a slave bellows through a rigid housing that is seal welded to the housing wall. Movement of the master bellows in the housing results in a corresponding movement of the slave bellows outside the housing. Feedback loops or calibration for thermal effects are also contemplated.

BRIEF DESCRIPTION OF THE DRAWING

The FIGURE is a schematic illustration of the actuation system acting on a final controlled element.

DETAILED DESCRIPTION OF THE PREFERRED EMBODIMENT

A housing 10 is illustrated schematically and is more likely than not a housing supported on a tubing string (not shown) for proper placement downhole adjacent the final controlled element, shown schematically as 12. The element 12 can be a variety of downhole tools that are either integral to the tubing string or supported by it. In the preferred embodiment the element 12 is one or more valves whose positions are changed over time to meet the well condition. These valves have a variable orifice and are connected to lines that run adjacent a tubing string. Movement represented by arrow 14, which can occur in opposed directions changes the size of an internal orifice in the valve when used as the element 12. The interior of the housing 10 is preferably filled with an incompressible liquid 16 and preferably excludes any compressible gas pockets. Temperature variations downhole can create thermal stresses as the fluid temperature of the liquid 16 changes. The pressure fluctuations that are thermally induced can be compensated by a bellows 18 whose volume can vary. The bellows 18 has a sealed end 20 and is welded at 22 to the wall of the housing 10. In that way it preferentially does not use seals that can leak at some point during a very long anticipated service life of the present invention.

Power is delivered into housing 10 through a line 24 that penetrates the wall of housing 10 in a sealed manner at 26. The motion source can be an electric motor that is built to run in a fluid filled environment of clean fluid such as 16. It can be a stepper motor or it can power a linkage such as a rack and pinion or screw. The desired result is an axial output movement as schematically represented by arrow 30 where the member 32 can be selectively driven in opposed directions while preferably maintaining continuous contact with a master bellows 34. A rigid housing 36 defines a passage therethrough 38 to the slave bellows 40. End 42 is sealed and the housing 36 is seal welded at its exterior to the housing 10. The movement of bellows 34 and 40 can be guided by optional guides 44 within the housing 10 for bellows 34 and 46 on the outside of housing 10 for bellows 40.

A position sensor 48 can optionally be used to determine the position of end 42 of bellows 40 which, in turn, allows personnel to know the position of the final controlled element 12. An information conduit represented by dashed line 50 can be bundled to the power line 26 to transmit the information obtained by the position sensor 48. Furthermore the position sensor can help establish a calibration point for a given temperature of the fluid 16. As the fluid 16 is warmed by well fluid that surrounds housing 10 the bellows 18 will respond to the fluid expansion as will bellows 34 to a lesser extent. Assembly at the surface can account for this thermal effect if the likely downhole temperature at the location of use is known with any certainty. Alternatively, a bench test in the lab before installation will reveal how much displacement of bellows 34 and 40 is to be expected at different downhole equilibrium temperatures and the input to the motor 28 can compensate for any displacement that has occurred due to thermal effects. There are other ways to get feedback in this control system.

Those skilled in the art will now appreciate that an actuator assembly can remain in service reliably for years due to isolation from well fluids that is provided by housing 10. There are no resilient seals that interact with moving parts to wear over time from either movement or exposure to well fluids. Even the power cable 24 at connection 26 can be fully protected in a control line or other sealed tube that extends from the surface. By using a unitary assembly of master and slave bellows 34 and 40 that features a tubular structure that joins them that is made of a material that can be seal welded to the housing 10, the motor assembly 28 is further protected. Preferably, the bellows 34 and 40 are built integrally to the tubular housing 36 to insure their structural integrity over a long service life. Making the bellows 40 integral to the tubular body 36 is clearly more important as that transition is exposed to well fluids.

A return spring 52 is schematically illustrated in the final controlled element 12 as one way to maintain contact between the reciprocating element 32 and end 54 of bellows 34. Those skilled in the art will appreciate that such a biasing member can also be located within housing 10 to act on member 32 to get the same result.

Bellows 34 and 40 do not need to have the same size or volume. By making the bellows sizes or volumes different their displacements can differ and the applied force can be enhanced or decreased depending on which bellows was bigger than the other. This is akin to the effect in hydraulic circuits where pistons of different sizes act on each other to boost pressure, for example.

Instead of power delivered with cable 24, motor 28 or its equivalent to create movement in item 32 can operate with a power source in the housing 10.

The above description is illustrative of the preferred embodiment and various alternatives and is not intended to embody the broadest scope of the invention, which is determined from the claims appended below, and properly given their full scope literally and equivalently.

I claim:

1. An actuator assembly for a final controlled element located in well fluid downhole, comprising:

a sealed housing against surrounding fluids;

an actuating device comprising a selectively movable actuating member and mounted wholly within said housing;

a force transfer member extending within and outside said housing and sealed to said housing to respond to movement of said actuating member to operate the final controlled element;

said force transfer member comprises a stationary tubular housing fixed to said sealed housing and sealed at opposed ends by movable members.

2. The assembly of claim 1, wherein:

said force transfer member is seal welded to an opening in said sealed housing.

3. The assembly of claim 1, wherein:

said sealed housing contains an incompressible fluid.

4. The assembly of claim 3, wherein:

said sealed housing is substantially filled with said incompressible fluid.

5. The assembly of claim 3, wherein:

said sealed housing comprises a compensation device responsive to thermal loads on said incompressible fluid from well fluid.

6. The assembly of claim 5, wherein:

said compensation device comprises a compensation bellows.

7. The assembly of claim 6, wherein:

said compensation bellows is seal welded to said sealed housing.

8. The assembly of claim 1, wherein:

said movable members comprise a master bellows located in said sealed housing and a slave bellows located outside said sealed housing.

9. The assembly of claim 8, wherein:

the movement of at least one of said master and slave bellows is externally guided.

10. The assembly of claim 8, wherein:

said master and slave bellows have different sizes.

11. The assembly of claim 8, wherein:

said master and slave bellows have different volumes.

12. The assembly of claim 1, wherein:

a position sensor associated with said force transfer member to provide knowledge as to movement of said force transfer member in response to force acting on said force transfer member induced by the well fluid.

13. The assembly of claim 12, wherein:

said position sensor is located outside said sealed housing.

14. The assembly of claim 13, wherein:

said movable members comprise a master bellows located in said sealed housing and a slave bellows located outside said sealed housing.

15. The assembly of claim 14, wherein:

said position sensor is mounted adjacent said slave bellows.

16. The assembly of claim 12, wherein:

said force transfer member is seal welded to an opening in said sealed housing;

said housing is substantially filled with incompressible fluid;

said position sensor detects movement of said force transfer member responsive to thermal effects on said incompressible fluid from well fluid.

17. The assembly of claim 1, further comprising:

a variable orifice valve operated by said force transfer member to serve as the final controlled member.

* * * * *